United States Patent [19]

Kawakami et al.

[11] Patent Number: 4,593,495

[45] Date of Patent: Jun. 10, 1986

[54] POLISHING MACHINE

[75] Inventors: Hideo Kawakami, Numazu; Shinichi Tazawa, Mishima; Masami Endo, Shizuoka, all of Japan

[73] Assignee: Toshiba Machine Co., Ltd., Tokyo, Japan

[21] Appl. No.: 674,663

[22] Filed: Nov. 26, 1984

[30] Foreign Application Priority Data

Nov. 25, 1983 [JP] Japan ..... 58-221828
Oct. 19, 1984 [JP] Japan ..... 59-219970

[51] Int. Cl.[4] ..... B24B 7/17

[52] U.S. Cl. ..... 51/118; 51/133; 51/131.2; 51/131.3

[58] Field of Search ..... 51/111 R, 113, 117–118, 51/129, 131.1–131.4, 132–133

[56] References Cited

U.S. PATENT DOCUMENTS 2,316,071 4/1943 Johnson ..... 51/118
3,089,292 5/1963 Hunt ..... 51/133 X

FOREIGN PATENT DOCUMENTS 5768747 10/1955 Japan .

*Primary Examiner*—Frederick R. Schmidt
*Assistant Examiner*—Debra S. Meislin
*Attorney, Agent, or Firm*—Oblon, Fisher, Spivak, McClelland & Maier

[57] ABSTRACT

A polishing machine for polishing the surfaces of the workpieces to be processed has upper and lower surface plates which are rotated relative to each other. A plurality of carriers are placed between the upper and lower surface plates and each of the carriers has a plurality of bores into which the workpieces are fitted. These carriers are engaged with both the sun gear and the internal ring gear within the same plane. In account of the sun gear and the internal ring gear, the carriers are rotated round the sun gear, turning round their own axes. The internal ring gear can be lifted up and down by a lift mechanism. The sun gear is slidably attached to a hollow driving shaft and has a feed screw which is engaged with a feed nut. This feed nut is rotatably fitted onto the hollow driving shaft in such a way that the nut is limited of its movement in the axial direction. The sun gear can be lifted up and down independently of the internal ring gear when an operating means including the feed screw and nut is operated.

13 Claims, 8 Drawing Figures

POLISHING MACHINE

BACKGROUND OF THE INVENTION

The present invention relates to a polishing machine for polishing the surface of a workpiece such as a wafer to be processed and, more particularly, it relates to a polishing machine wherein the workpieces are fitted in carriers, which are placed between upper and lower surface plates, which are rotated relative to each other and the carriers are rotated round a sun gear by means of the sun gear and an internal ring gear, turning round their own axes, whereby the surfaces of the workpieces to be processed are polished by an abrasive cloth or cloths attached to one or both of the surface plates.

FIG. 1 shows a conventional polishing machine of this type. This type of the polishing machine is proposed in Japanese Utility Model Disclosure No. 68747, 1982. The polishing machine includes upper and lower surface plates 10 and 12. Abrasive cloths 14 and 16 are stuck to the upper and lower surface plates. The lower surface plate 12 is rotatably supported by a base 18 through bearings while connected to a driving device (not shown) through a gear 20. On the other hand, the upper surface plate 10 is suspended, movable up and down, from a main cylinder 22 fixed to a frame 24. The upper surface plate 10 has a bore 26 with which a spline shaft 28 of a shaft 30 is detachably engaged. The shaft 30 is connected to a driving device (not shown) through a gear 32.

A plurality of carriers 34 are placed between the upper and lower surface plates 10 and 12, and each of the carriers 34 has a plurality of bores into each of which a workpiece W to be processed is fitted. Each of the carriers 34 is in mesh with both of sun gear 36 and internal ring gear 38. The sun gear 36 and the internal ring gear 38 are arranged concentric with each other. The sun gear 36 is rotated by a gear 42 attached to a hollow driving shaft 40, while the internal ring gear 38 by a gear 44. Therefore, the carriers 34 are rotated round the sun gear 36, turning round their own axes, as the planet gear of planetary gears.

In the case of this conventional polishing machine, however, the internal ring gear 38 or sun gear 36 wears when used for a long time, and it is therefore necessary to change the position at which the carriers 34 are in mesh with the internal ring gear 38 or sun gear 36. Further, it is also necessary that the sun gear 36 and the internal ring gear 38 are moved up and down for the purpose of easily picking up the workpieces after their polishing process. In order to solve these problems, a lift mechanism for lifting the sun gear 36 and the internal ring gear 38 according to the prior art has a screw jack 46, which is attached to the internal ring gear 38 through an arm 48 while also attached to the sun gear 36 through the arm 48, coupling members 50, 52 and hollow driving shaft 40. When the screw jack 46 is operated, the internal ring gear 38 and the sun gear 36 are simultaneously moved up or down.

This lift mechanism for the sun gear 36 and the internal ring gear 38 becomes complicated in structure, thereby making its cost high. In addition, the sun gear 36 and the internal ring gear 38 cannot be moved up and down independently. Therefore, the position at which the carriers 34 are in mesh with one of gears 36 and 38 cannot be adjusted independently of the position at which the carriers 34 are in mesh with the other, although both gears 36 and 38 are differently worn by the carriers 34.

SUMMARY OF THE INVENTION

The object of the present invention is therefore to provide a polishing machine of the above-described type provided with a simple mechanism for moving the sun gear up and down independently of the internal ring gear.

According to the present invention, there is provided a polishing machine for polishing the surface of a workpiece comprising a base; a driving shaft rotatably attached to the base; a first surface plate rotatably attached to the base and provided with the plate surface, the first surface plate having a throughhole which the driving shaft is passed through; a sun gear connected to the driving shaft to slide in the axial direction of the driving shaft and provided with a projection enclosing the driving shaft, the projection extending along the driving shaft and having a threaded portion on the outer circumference thereof; an internal ring gear arranged concentric with and enclosing the sun gear; a plurality of carriers arranged between the sun gear and the internal ring gear within the same plane, the carriers being in mesh with the sun gear and the internal ring gear, and lying on the first surface plate, each of said carriers having a plurality of through-bores in which the workpieces are housed; a driving means for moving the internal ring gear to engage with or disengage from the carriers, and for rotating the internal ring gear; a sun gear actuating member attached to the driving shaft, limited of its movement in its axial direction, and provided with a threaded portion which is screwed onto the threaded portion of the projection of the sun gear which serves as the feed screw; a second surface plate arranged apart from the first surface plate and provided with a plate surface which faces the plate surface of the first surface plate; a second surface plate moving means for moving the second surface plate to approach and separate from the first surface plate; and an abrasive member attached to the plate surface of one of the first and second surface plates to polish the surfaces of the workpieces.

In the polishing machine as described above, the sun gear and the internal ring gear can be lifted up and down independently.

DETAILED DESCRIPTION OF THE PREFERRED EMBODIMENT

A first embodiment of the polishing machine according to the present invention will be described referring to FIGS. 2 through 4.

Figure 1:
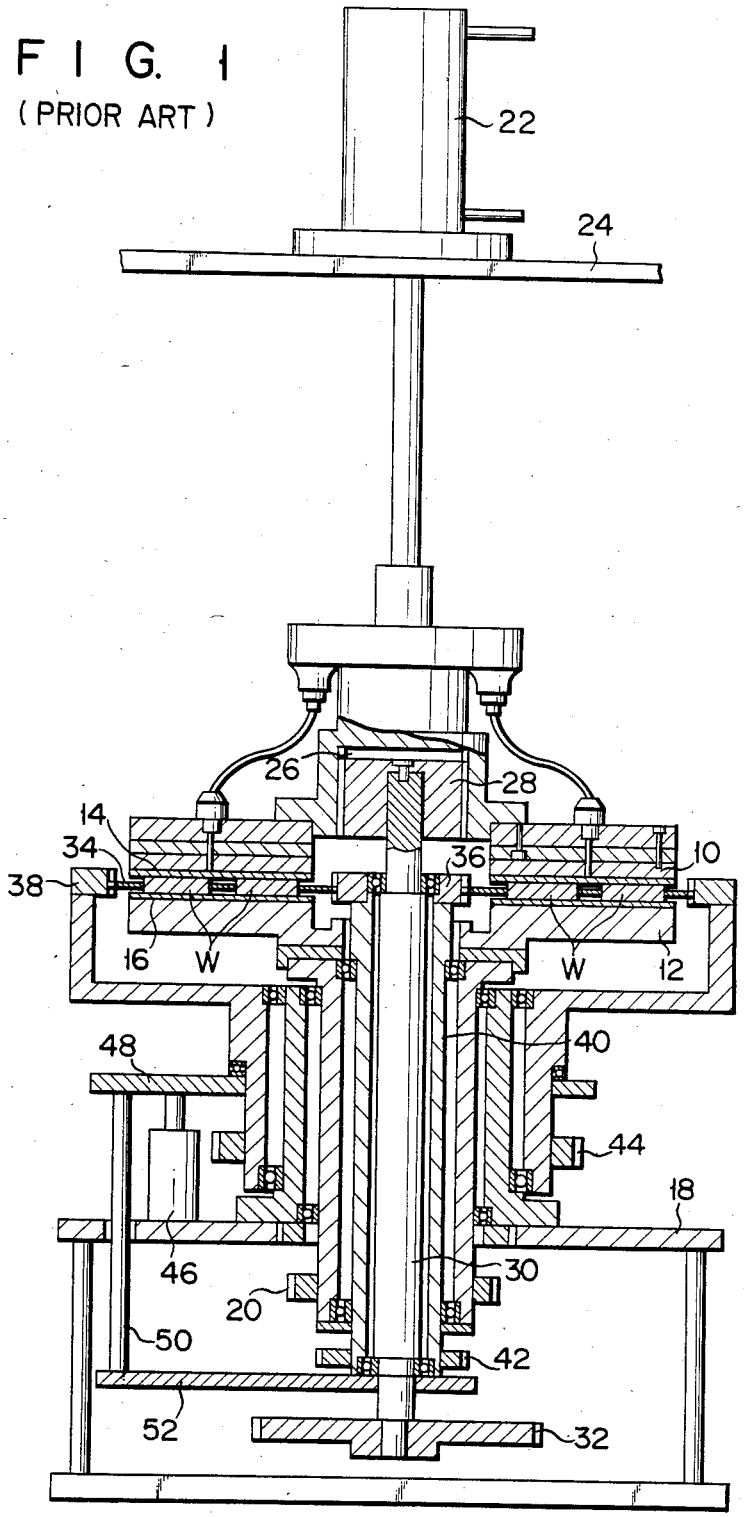
FIG. 1 (PRIOR ART)
FIG. 1 is a sectional view showing a conventional polishing machine.
Figure 2:
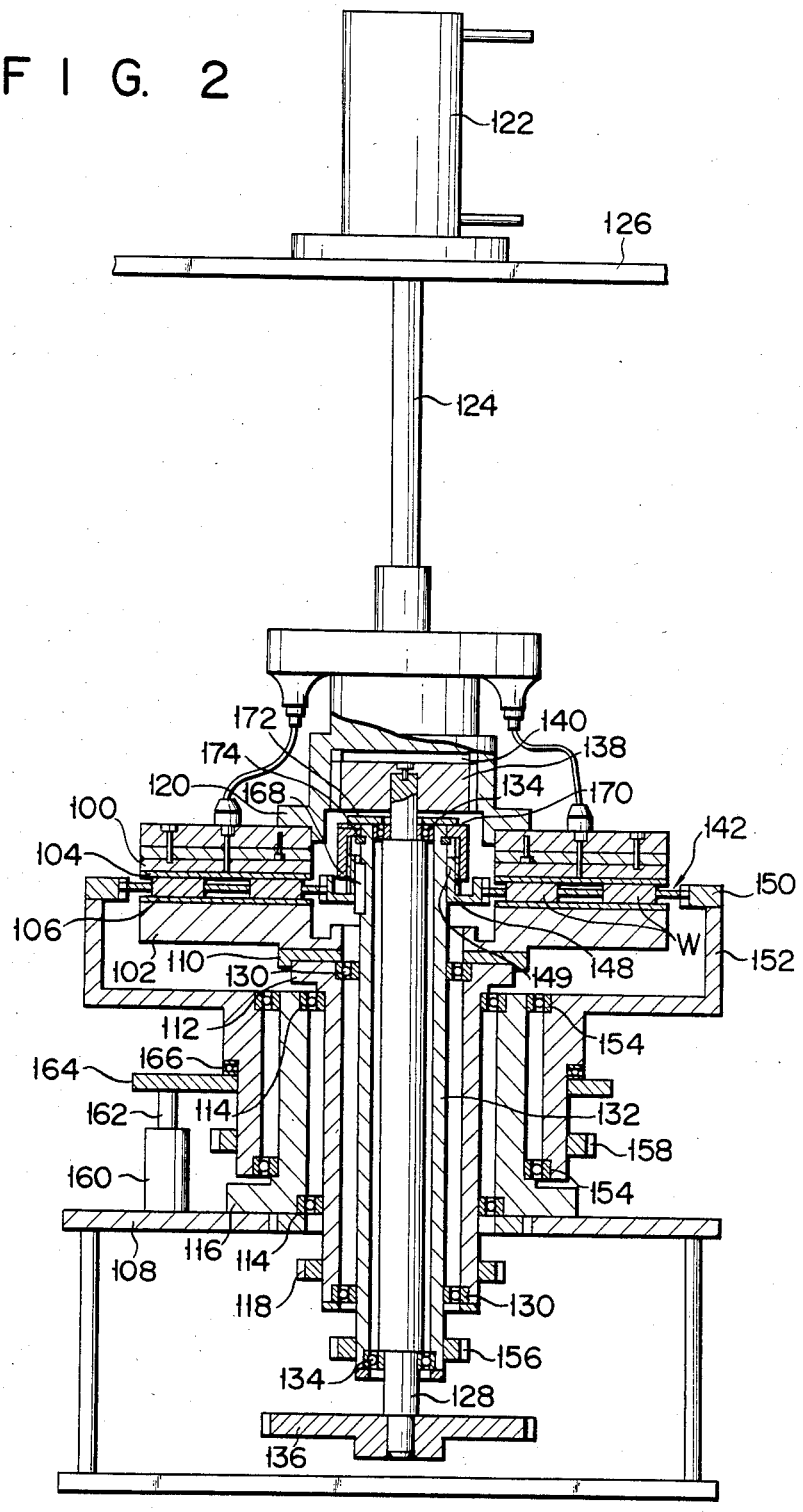
FIG. 2 is a sectional view showing an example of the polishing machine according to the present invention.

FIG. 2 is a sectional view showing the polishing machine of the present invention. The polishing machine has upper and lower surface plates 100 and 102. Abrasive cloths 104 and 106 are stuck to the surfaces of these upper and lower surface plates 100 and 102 which are opposite to each other. The lower surface plate 102 is rotatably supported on a base 108 through a bearing holder 110, hollow shaft 112, bearings 114 and a bearing metal 116. A gear 118 is attached to the hollow driving shaft 112 and connected to a driving device (not shown). The hollow driving shaft 112 can be rotated by this driving device. On the other hand, the upper surface plate 100 is suspended from a coupling 120, which is connected to a main cylinder 122 through a piston rod 124. The main cylinder 122 is fixed to a frame 126. Therefore, the upper surface plate 100 can be moved up and down by the main cylinder 122.

A driving shaft 128 is rotatably inserted into the hollow driving shaft 112 via bearings 130, a hollow driving shaft 132 (which will be described later), and bearings 134. A gear 136 is attached to the lower end of the shaft 128 and connected to a driving device (not shown). The driving shaft 128 can be rotated by the driving device in a reverse direction to the rotating direction of the hollow driving shaft 112. A coupling 138 is provided at its outer peripheral surface with a spline. The coupling 138 is attached to the upper end of the shaft 128 and detachably engaged with a bore 140 formed in the coupling 120. The bore 140 has grooves which is engaged with a spline provided at the outer peripheral surface of the coupling 138. The coupling 138 may be engaged with the coupling 120 through a sliding key instead of the spline.

Figure 3:
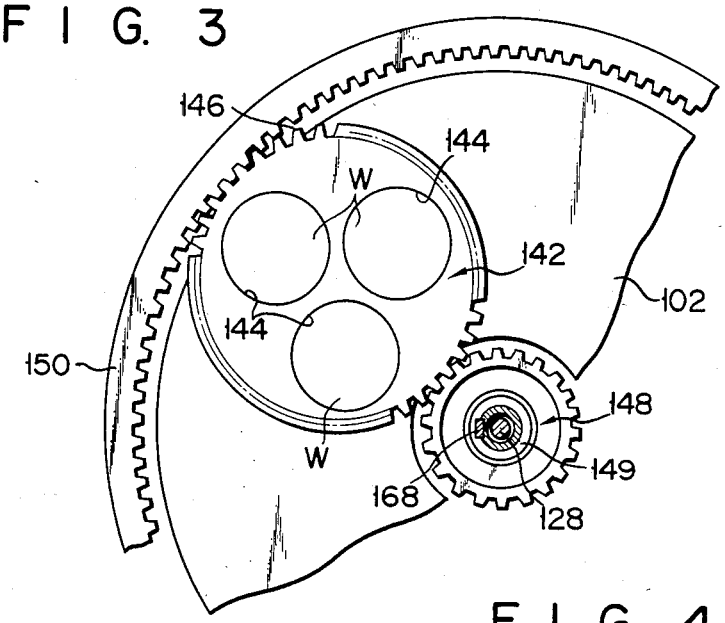
FIG. 3 is a plan view showing how a sun gear, carrier and internal ring gear are engaged with one another.
Figure 4:
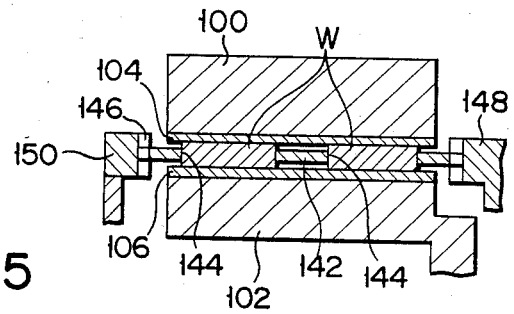
FIGS. 4 and 5 are enlarged sectional views showing main portions of the polishing machine in FIG. 2.

As shown in FIGS. 3 and 4, a plurality of carriers 142 are located between the upper and lower surface plates 100 and 102. Each of the carriers 142 is provided with a plurality of through-holes. A workpiece to be processed is fitted in each of the through-holes 144, and each of the carriers 142 defines the position of the workpieces W to be processed and holds them. Teeth 146 are formed on the outer circumference of the carrier 142. These teeth 146 are in mesh with those of a sun gear 148 and internal ring gear 150, respectively. As shown in FIG. 2, the sun gear 148 is arranged at the upper portion of the hollow driving shaft 132, while the internal ring gear 150 is connected to an internal gear support member 152, which is rotatably attached to the bearing metal 116 through bearings 154. Gears 156 and 158 are attached to the hollow driving shaft 132 and bearing metal 116, respectively, and connected to driving devices (not shown). The hollow driving shaft 132 and bearing metal 116 can be rotated by these driving devices and the sun gear 148 and internal ring gear 150 can also be rotated. As apparent from FIG. 3, the carrier 142 is rotated round the axial line of the shaft 128, turning round its own axis, when the sun gear 148 and internal ring gear 150 are rotated. In other words, the carrier 142 is used as the planet gear of planetary gears.

Referring to FIG. 2 again, lift mechanisms for the internal ring gear 150 and the sun gear 148 will be described.

The lift mechanism for the internal ring gear 150 comprises a screw jack 160 provided with an output shaft 162, and a lift arm 164 connected to the output shaft 162. The internal gear support means 152 which is connected to the internal ring gear 150 is rotatably supported by the lift arm 164 through a bearing 166.

Figure 5:
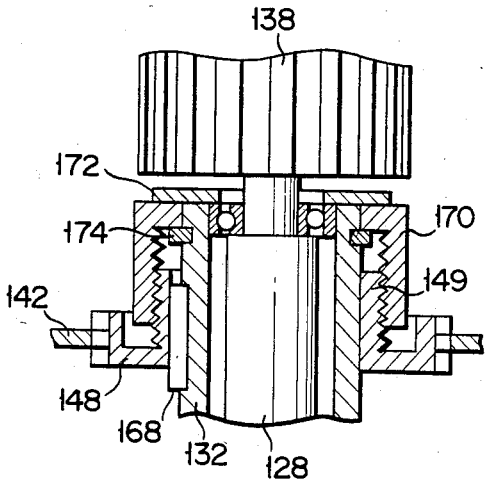

FIG. 5 shows the lift mechanism for the sun gear 148. The sun gear 148 is attached to the hollow driving shaft 132 through a sliding key 168 to slide only in the axial direction of the hollow shaft 132. A feed nut 170 which serves as the operating member is rotatably and loosely attached to the upper end of the hollow driving shaft 132 between a pressing plate 172 and a stopper ring 174. The movement of the feed nut 170 in the axial direction of the hollow shaft 132 is limited by these pressing plate 172 and stopper ring 174. The inner thread of the feed nut 170 is screwed onto the feed screw 149 formed on the center portion of the sun gear 148.

Now, the operation of the polishing machine with the above-mentioned structure will be described. The upper surface plate 100 is moved upward by the main cylinder 122. Plural workpieces W to be processed are fitted in the through-bores 144 of the carriers 142 and thus mounted on the lower surface plate 102 under this opened state. The upper surface plate 100 is lowered to its predetermined lower position by means of the main cylinder 122. The workpieces W are pressed by processing pressure which is set a predetermined value. Namely, the workpieces W are sandwiched between the upper and lower abrasive cloths 104 and 106 under the predetermined pressure. The gears 118, 136, 156 and 158 are rotated by the driving devices (not shown) to rotate the upper and lower surface plates 100, 102, sun gear 148 and internal ring gear 150, respectively, thereby enabling the workpieces W to be polished.

The operation of the lift mechanism for the sun gear 148 will be described.

When the feed nut 170 is operated and rotated, reciprocating force in the axial direction is caused to move the sun gear 148 in the same direction. The sun gear 148 can be thus lifted up and down independently of the internal gear 150.

Although the sliding key 168 has been employed by this first embodiment as the means for sliding the sun gear 148 in the axial direction of the hollow shaft 132, a means which enables spline engagement may be used instead.

Figure 6:
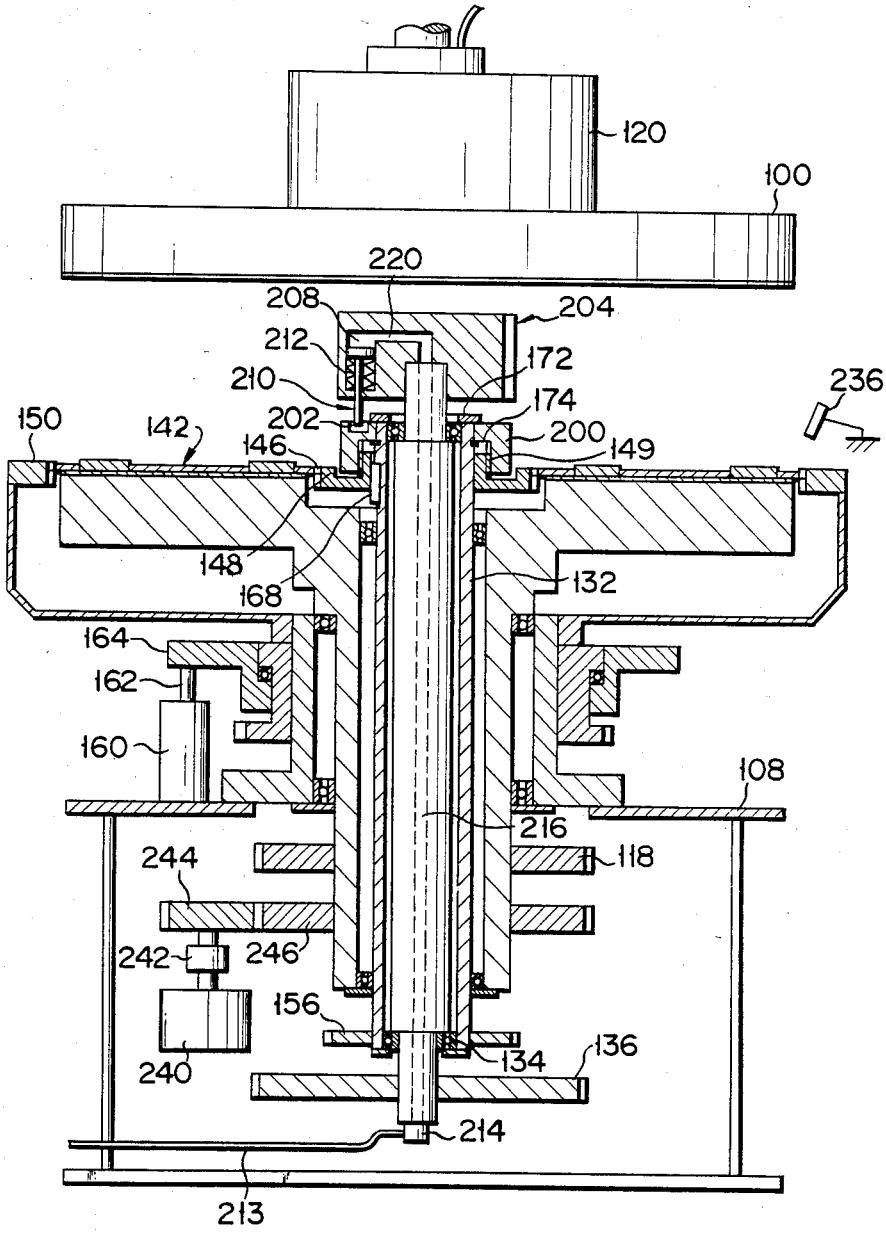
FIG. 6 is a sectional view showing, particularly, a lift mechanism for the sun gear and the internal ring gear in the case of a different example of the polishing machine according to the present invention.
Figure 7:
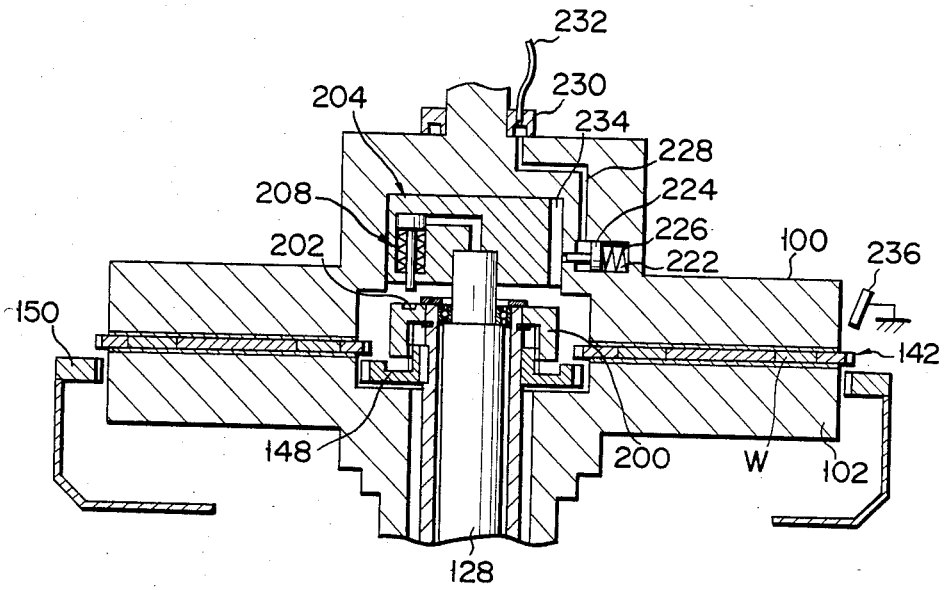
FIGS. 7 and 8 are sectional views intended to explain indexing of the workpieces and carriers in the case of the polishing machine shown in FIG. 6.
Figure 8:
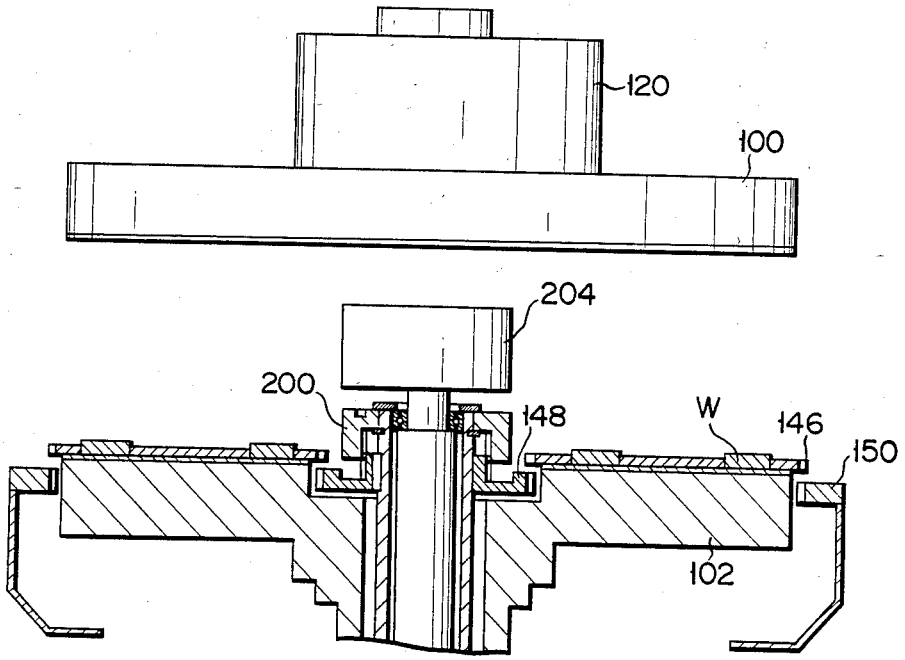

A second embodiment of the present invention will be described referring to FIGS. 6 through 8. In FIGS. 6 through 8, same parts as those in the first embodiment shown in FIGS. 2 through 5 will be represented by same reference numerals.

FIG. 6 is a sectional view showing the polishing machine in accordance with the second embodiment. The polishing machine shown in FIG. 6 is different from that shown in FIGS. 2 to 5. In the case of this second embodiment, a recess 202 is formed on the upper surface of a feed nut 200. Further, a coupling 204 is attached to the upper portion of the driving shaft 132 and provided with a chamber 208 for housing a piston 210 moving up and down. Said piston 210 serves as the interrupting means and is urged upward by a spring 212.

On the other hand, a pipe 213 is connected to the lower end of the driving shaft 132 through a rotary joint 214, and compressed air is supplied from a compressed air supply source (not shown) to the pipe 214. Formed inside the hollow driving shaft 132 is a passage 216 therewith, which is communicated with the chamber 208 through a communication passage 220 formed in the coupling 204. The piston 210 is moved up and down, depending upon the supply and supply stop of the compressed air, thereby causing its lower end portion to come in and out of the recess 202 on the feed nut 200.

A chamber 222 for movably housing a key 224, which serves as the interrupting means, is also formed in the coupling 204 for the upper surface plate 100, and the key 224 is urged by a spring 226. The chamber 222 is communicated to a pipe 232 through a communication passage 228 and a rotary joint 230, and compressed air is supplied from a compressed air supply source (not shown) to the chamber 222 through a pipe 232. The key 224 is reciprocated, depending upon the supply and supply stop of the compressed air, thereby causing its front end portion to contact with and separate from a key groove 234 in the coupling 204.

A sensor 236 is arranged adjacent to the lower surface plate 102, and the carriers 142 are detected by this sensor 236 to thereby control the rotation amount of the gear 118 for driving the lower surface plate 102, and also index the indexing position of the carriers 142 and workpieces W at the unloading time.

In a case where the sun gear 148 is lifted up and down to change the engagement position of the sun gear 148 relative to the carriers 142, the upper surface plate 100 is lifted and detached from the coupling 204. The gear 136 is rotated to rotate the coupling 204 at low speed through the driving shaft 128. Compressed air is supplied to the head side of the piston 210 through the pipe 213, rotary joint 214, passage 216 in the driving shaft 128 and communication passage 220 in the coupling 204. When the piston 210 is moved opposite to the recess 202 on the feed nut 200 under this state, the piston 210 is moved downward against the spring 212 and inserted into the recess 202, thereby causing the coupling 204 to be coupled to the feed nut 200. Therefore, the feed nut 200 is only rotated, but not reciprocated because its movement in the axial direction is limited by the pressing plate 172 and stopper ring 174. Its rotation force becomes a force for rotating the hollow driving shaft 132 through the feed screw 149, or is slid at the portion of its being engaged with the key 168 to become a reciprocating movement in the axial direction of the feed screw 149. Since the force of rotating the hollow driving shaft 132 is too strong, it causes the feed screw 149 to be reciprocated, thereby the sun gear 148 is automatically lifted up and down.

The amount of the sun gear 148 moved up and down is controlled by controlling the rotation amount of the gear 136. Needless to say, the sun gear 148 can be lifted up and down by manually operating the feed nut 200.

There will be, as described, a case where polishing of the workpieces W has been finished and where the carriers 142 are indexed and fed to unload the carriers 142 and workpieces W. As described above, the internal ring gear 150 and the sun gear 148 are moved down and released from the carriers 142. The lower surface plate 102 or the upper and lower surface plates 100 and 102 are rotated to move the carriers 142 to their predetermined position. However, raising upper surface plate to lower sun gear 148, as described above, is undesirable, because some workpieces W, which are relatively light, may be adhered to abrasive cloth 104 and removed from carriers 142.

As shown in FIG. 7, therefore, compressed air is supplied to the rod side of the key 224 through the passage 228, rotary joint 230 and pipe 232, leaving the upper surface plate 100 substantially not separated from the workpieces W. The key 224 is retreated against the spring 222 and apart from the key groove 234 in the coupling 204 for the driving shaft 128, thereby causing the coupling 120 for the upper surface plate 100 to be separated from the coupling 204 for the driving shaft 128. When the driving shaft 128 is rotated under this state, the upper surface plate 100 is not rotated, and the sun gear 148 is moved down via the coupling 204, piston 210 and feed nut 200, thus released from the carriers 142. The internal gear 150 is lowered by the screw jack 160. Only the lower surface plate 102 is driven and controlled to index and move the carriers 142. The upper surface plate 100 is on the lower surface plate 102 this time in such a way that the former lies on the latter with its dead load and that the workpieces W and carriers 142 are held between the upper and lower surface plates 100 and 102.

Indexing and moving of the carriers 142 and workpieces W may be carried out by lifting the upper surface plate 100 and driving and controlling only the lower surface plate 102 after the finish of the polishing process, as shown in FIG. 8, when the workpieces W are treated not to adhere to the upper surface plate 100 by any suitable means.

According to the second embodiment of the present invention, the sun gear 148 can be lifted up and down independently of the internal gear 150 so that the positions of both gears 148 and 150 at which they are engaged with the carriers 142 can be adjusted independently. In addition, the lift of the sun gear 148 can be automated since power for driving the upper surface plate 100 is used.

According to the second embodiment of the present invention, the sun gear 148 can be lifted up and down, leaving the carriers 142 and workpieces W held between the upper and lower surface plates 100 and 102, when the interrupting means such as the key 224 between the upper surface plate 100 and the coupling 204 is provided to cause the surface plates to be contacted with and separated from the system for driving the sun gear 148 up and down. In addition, the sun gear 148 can be lifted up and down without shifting the carriers 142 and workpieces W in their position.

Although the lower surface plate 102 is rotated by the gear 118 at the time of indexing and moving the carriers 142 in the case of the second embodiment, a driving device 240 which is used exclusively for indexing may be provided and the lower surface plate 102 may be connected to the driving device 240 through a clutch 242 and gears 244, 246, so that the lower surface plate 102 can be rotated by the driving device 240, as shown in FIG. 6.

The foregoing presently preferred embodiments are exemplary only, and do not preclude inclusion of such modifications and variations to the present invention that would be readily apparent or obvious to one of ordinary skill in the art, the scope of the present invention being set forth in the following appended claims.

What is claimed is:

1. A polishing machine for polishing the surface of a workpiece comprising:

a base;

a driving shaft rotatably attached to the base;

a first surface plate rotatably attached to said base and provided with a plate surface, said first surface plate having a through-hole which the driving shaft is passed through;

a sun gear slidably connected to said driving shaft to slide in the axial direction of said driving shaft and provided with a projection enclosing said driving shaft, said projection extending along said driving shaft and having a threaded portion on an outer circumference thereof;

an internal ring gear on said base and arranged concentric with said sun gear and enclosing said sun gear;

a plurality of carriers arranged between said sun gear and said internal ring gear within the same plane, said carriers being in mesh with said sun gear and said internal ring gear, and lying on said first surface plate, each of the carriers having a plurality of through-bores in which the workpieces are housed;

a driving means for moving said internal ring gear to engage with or disengage from said carriers, and means for rotating said internal ring gear;

a sun gear actuating member attached to said driving shaft, limited of its movement in the axial direction, and provided with a threaded portion which is screwed onto the threaded portion of the projection of said sun gear which serves as a feed screw for adjusting the axial location of the sun gear relative to the carriers;

a second surface plate arranged apart from said first surface plate and provided with a plate surface which faces that of said first surface plate;

a second surface plate moving means for moving said second surface plate to approach and separate from said first surface plate; and an abrasive member attached to the plate surface of at least one of said first and second surface plates to polish the surfaces of the workpieces.

2. A polishing machine according to claim 1, wherein said abrasive member is attached to the plate surfaces of both said first and second surface plates.

3. A polishing machine according to claim 2, wherein said driving shaft includes a first driving shaft for rotating said second surface plate, and a second hollow driving shaft arranged concentric with the first driving shaft and enclosing it, and wherein the second driving shaft rotates said sun gear and said sun gear actuating member is attached to one end of the second driving shaft.

4. A polishing machine according to claim 3, wherein a sliding key is provided between said sun gear and the second driving shaft and said sun gear is slidably attached to the second driving shaft through the sliding key.

5. A polishing machine according to claim 3, wherein a spline-engaging means is provided between said sun gear and the second driving shaft and said sun gear is slidably attached to the second driving shaft by means of the spline-engaging means.

6. A polishing machine according to claim 4, wherein the first driving shaft has a spline at one end thereof while the second surface plate has a bore in the center portion thereof corresponding to the spline, and the spline is adapted to engage with and disengage from the bore in the axial direction.

7. A polishing machine according to claim 4, wherein the first driving shaft has a coupling at one end thereof while said second surface plate has a bore in the center portion thereof, and the coupling is adapted to engage with and disengage from the bore in the axial direction and to engage and disengage from the sun gear actuating member.

8. A polishing machine according to claim 7, further including a first clutch means for allowing or preventing the transmission of a driving force which is transmitted from the coupling to the sun gear actuating member.

9. A polishing machine according to claim 8, wherein said first clutch means comprises a recess formed on the surface of said sun gear actuating member, a cylinder chamber formed in the coupling, a piston housed in the cylinder chamber and engageable with the recess, and a spring housed in the cylinder chamber to urge the piston to separate from the recess, and wherein the cylinder chamber is communicated with a compressed air supply source through a passage formed in the coupling and the first driving shaft.

10. A polishing machine according to claim 9, further including a second clutch means for allowing or preventing the transmission of the driving force which is transmitted from the coupling to said second surface plate.

11. A polishing machine according to claim 10, wherein said second clutch means comprises a groove formed on the circumference of said coupling in the axial direction thereof, a cylinder chamber formed in said second surface plate, a piston housed in the cylinder chamber and engageable with the groove, and a spring for urging the piston toward the groove, and wherein the cylinder chamber is communicated with a compressed air supply source through a passage formed in the second surface plate.

12. A polishing machine according to claim 11, wherein said driving shaft further includes a third hollow driving shaft arranged concentric with the first and second driving shafts and enclosing the second driving shaft, and said first surface plate is connected to the third driving shaft.

13. A polishing machine according to claim 12, further including a driving means connected to the third driving shaft through a third clutch means, wherein said first surface plate is rotated by the driving means to enable the carriers and the workpieces to be indexed.

* * * * *